US005355950A

United States Patent [19]

Zwart

[11] Patent Number: 5,355,950

[45] Date of Patent: Oct. 18, 1994

[54] CENTRALISER

[76] Inventor: Klaas Zwart, Drumgarth Road, Cults Aberdeen AB1 9NX, United Kingdom

[21] Appl. No.: 117,202

[22] Filed: Sep. 15, 1993

[30] Foreign Application Priority Data

May 25, 1991 [GB] United Kingdom ..... 9111381

[51] Int. Cl.[5] ..... E21B 17/10

[52] U.S. Cl. ..... 166/241.6; 166/241.5; 73/866.5

[58] Field of Search ..... 166/241.6, 241.1, 241.4, 166/241.5, 64; 73/866.5; 33/544.3

[56] References Cited

U.S. PATENT DOCUMENTS

| | | | |
|---|---|---|---|
| 2,748,874 | 6/1956 | Spencer | 166/241.5 X |
| 2,812,587 | 11/1957 | Roussin | 166/241.5 X |
| 3,087,552 | 4/1963 | Graham | 166/243 |
| 3,568,053 | 3/1971 | Kilpatrick et al. | 324/722 |
| 4,523,640 | 6/1985 | Wilson | 166/64 |
| 4,776,397 | 10/1988 | Akkerman | 166/241.5 |
| 4,843,896 | 7/1989 | Napeloni et al. | 73/866.5 |

FOREIGN PATENT DOCUMENTS

| | | |
|---|---|---|
| 0300627 | 1/1989 | European Pat. Off. . |
| 2155519 | 9/1985 | United Kingdom . |
| 2173553 | 10/1986 | United Kingdom . |

*Primary Examiner*—Stephen J. Novosad
*Attorney, Agent, or Firm*—Lalos & Keegan

[57] ABSTRACT

A centralizer (1) is used for passing assemblies and tools through bores and tubular ducts in a centralized condition, especially in downhole operations in oil work. The centralizer comprises a body (2) including carrying means (3) pivotally supporting swinging arms (4) for effecting centralization. Each arm (4) is pivotally located (14) at one end while a roller (15) or other implement is carried at or adjacent the other free end. Actuating means (6,5) including force means (7), such as a spring, load the swung-out arms (4) so that the arms (4) act against the force means (7) when pushed inwardly. The arms (4) are preferably located tangentially on the carrying means (3) and an adjuster (8) for the force means (7) can be provided.

20 Claims, 2 Drawing Sheets

CENTRALISER

The present invention relates to a centraliser enabling assemblies or tools to pass through bores or tubular ducts and also through restrictions in the ducts all while being biased towards a centralised condition. The invention finds particular use in downhole operations in oil work.

Centralisers for use down-well are known, and examples are shown in GB-A-2155519, GB-A-2216571, GB-A-2173533, and U.S Pat. Nos. 4,776,397 and 4,557,327. The prior art centraliser devices of these patent specifications utilise swingable roller arms for centralising, with the swinging action of the arms countered by spring means. However these prior art devices generally are complicated and have limitations in their operation. It is the principal object of the present invention to provide an improved centraliser overcoming those disadvantages.

A further known centraliser is described in EP-A0300627 and in particular has swingable roller arms which swing in generally tangential planes off-set from the centre line of the centraliser body portion carrying the arms, as distinct from the more prevalent pure radial swinging of the arms.

It is the principal object of the present invention to provide a centraliser having a compact radial dimension in the retracted condition but which is effective in operation.

Preferably the actuating means comprise a series of actuators each associated with a respective swinging arm, and means are provided to enable the actuators to swing the arms simultaneously. Each actuator can engage its respective arm at a point spaced from the arm pivot point to provide a fulcrum lever for effecting the swinging action. Preferably the carrying means includes an elongate member of a generally polygonal cross section, and a swinging arm is pivotally attached to each flat surface of the elongate member so than in the retracted position the arm lies adjacent the flat surface. More especially the elongate member is generally of triangular cross-section and three swinging arms are provided.

Preferably load adjusting means are provided comprising an adjuster member mounted to be axially movable relative to the body, with the loading means located between the adjuster member and an actuator member. In particular, the adjuster member can be movably connected to the body. Preferably locking means are provided to lock the adjuster member in set positions.

In a preferred embodiment, the loading means comprises a spring, preferably in the form of a stack of belville washers carried by a spindle. The centraliser arrangement enables the spring to be relatively long and this is operationally advantageous.

An embodiment of the present invention will now be described by way of example with reference to the accompanying drawings wherein.

Figure 1:
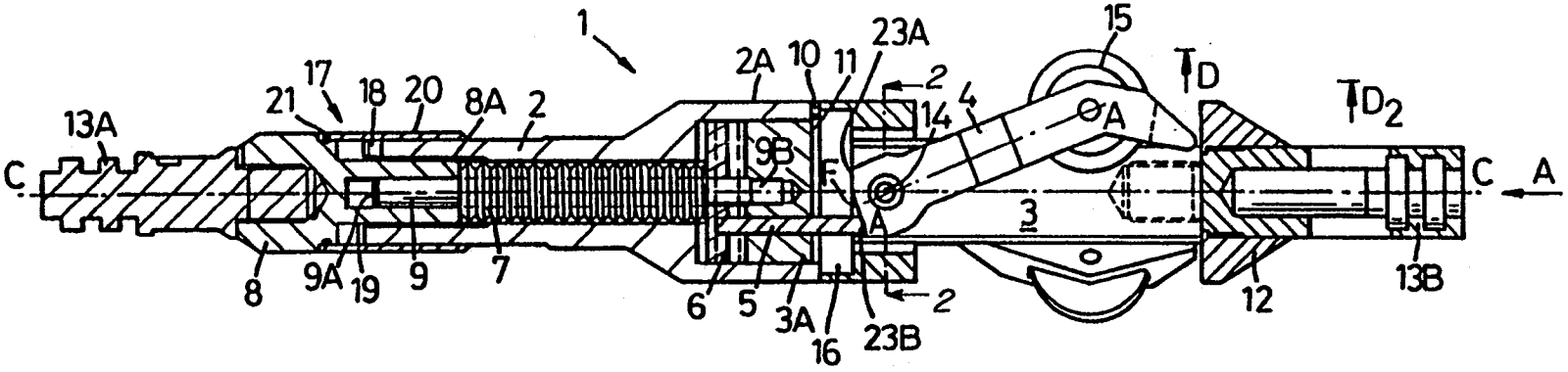
FIG. 1 shows a sectional side view of a centraliser for centralising the passage of tools through a bore, or duct.
Figure 4:
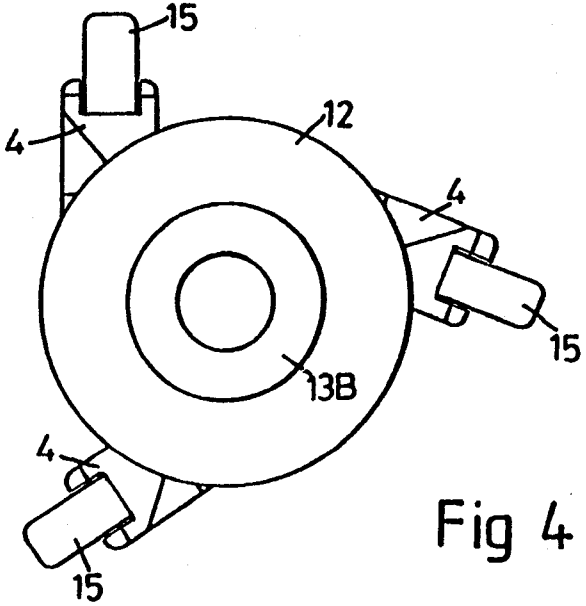
FIG. 4 shows an end view of the centraliser looking in the direction of arrow 4.

Referring to the drawings, a centraliser 1 is provided to enable the passage of a tool such as a plug or lock through a restriction bore in tubing and the like, and especially to allow the assembly including the plug/-lock to pass through a minimum restriction, such as a safety valve, and then pass into a larger inside diameter zone still centralised. The centraliser therefore will facilitate the placement of the plug or lock in its respective nipple. The centraliser 1 comprises a main body part 2 of tubular form with a large diameter end portion 2A, a support assembly 3 for swinging arms 4 no effect centralisation, actuator rods 5 for swinging the arms 4 between stored and extended conditions, the rods 5 being carried by a support/pusher member 6 in the large diameter head part 2A, a compression spring 7 located between the pusher member 6 and a spring compressing member 8 threaded at 8A to the inside diameter of the tubular body part 2. and a spindle 9 for locating spring 7 having one end 9A slidingly received in a socket in the member 8 and the other end 9B screwed to an end face of the assembly 3. The assembly 3 has one end in the form of a plug 3A which is received in the large diameter head part 2A to locate the assembly, the assembly 3 being secured by means of a grub screw 10 penetrating a groove 11 in the plug 3A, while the other end of the assembly 3 carries a frusto-conical block 12 to facilitate placement of the centraliser 1 in a tubular member. Adapter connectors 13A/13B at the ends of the centraliser 1 serve for the installation of the centraliser in a string as appropriate.

Figure 2:
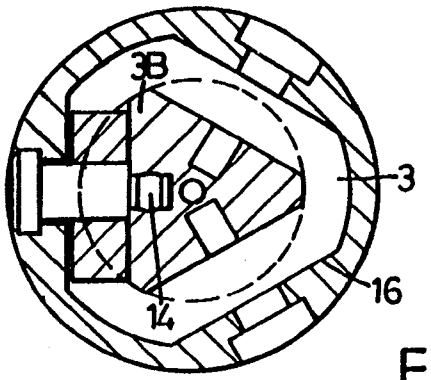
FIG. 2 shows the section 2—2 in FIG. 1.
Figure 3:
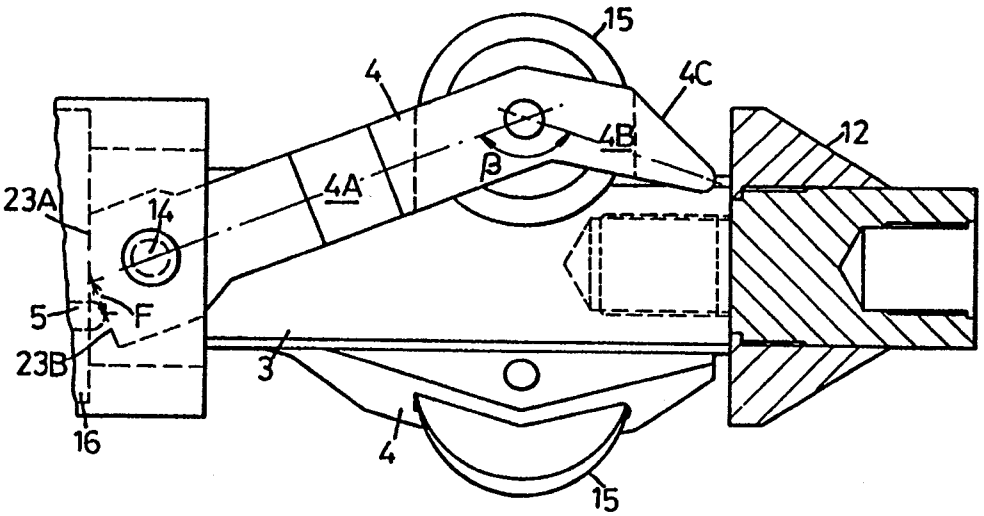
FIG. 3 shows a side view of the support assembly portion of the centraliser to a larger scale.

The assembly 3 carried three swinging arms 4 on a portion 3B of triangular cross-section (see FIG. 2), each swinging arm 4 being pivotally joined to the portion 3B by a pivot pin 14 so that the arm lies parallel to and adjacent a respective flat surface of the portion 3B, while the actuating rods 5 engage an end face 23A of the respective arms 4 on a fulcrum lever F acting about the pivot point of pins 14, whereby axial movement of the rods 5 cause a swinging movement of the arms 4. The arrangement enables the axis A—A of each arm 4 in the retracted state to lie on the horizontal plane through the centre line C—C of the centraliser 1 when viewed in side view: this encourages a compact device. The free end of each arm 4 carries a roller 15. Each arm 4 is of cranked form with a main portion 4A including the pivot axis 14 and an outer nose portion 4B, the two portions 4A, 4B forming an inwardly facing obtuse angle $\beta$. The roller 15 is located at the elbow of the cranked arm 4. Further the nose portion 4B includes a tapering tip 4C to assist the tool to pass over square shoulders and also through recesses. For robustness, each arm 4 comprises a hollow body with the roller 15 extending through slots in the body. As the load on spring 7 is reduced, the arms 4 can swing inwardly under gravity.

The assembly 3 includes a head 16 located over and against a diameteral shoulder adjacent to plug 3A, the head 16 having flat peripheral edge portions (see FIG. 2) to preclude axial movement of arms 4 along the pivot pins 14.

The spring 7 preferably comprises a stack of belville washers as shown and as can be seen the spring 7 is of relatively lengthy form. Rotation of the compressing member 8 in the body 2 causes axial movement of the member 8 to compress the spring 7 (with arms 4 stationary) and thereby provide a variable centraliser spring force. The member 8 is locked in a desired position (corresponding to chosen spring force) by means of a locking device 17 which is the subject of the present applicants UK Patent Application No 9106737.1 filed Mar. 28, 1991. Briefly the device 17 comprises a movable segment 18 located in a through-slot in the body 2, teeth in the segment 18 engaging grooves 19 on the member 8, and a sleeve 20 for retaining the segment 18 in is slot. The device 17 locks the member 8 by virtue of any tendency for relative axial movement between the member 8 and the body 2 causing the segment 18 to move outwardly (due to force reaction between the segment 18 and the grooves 19) and to jam against the sleeve 20 to preclude such axial movement. The sleeve 20 can be screwed back to permit freeing of the segment 18 for resenting of the member 8; and the sleeve 20 can be secured for example by means of a grub screw 21.

A particular centraliser 1 can have a specific expansion value defined by the diameter of the circle circumscribing the rollers 15 in the extended condition, the maximum extension being limited by face 23A of the arm abutting the head 16 of the assembly 3. For example a centraliser 1 may have an expansion value up to 8 inches (20.32 cm).

With the arms 4 extended, the centraliser 1 can pass through a pipe or duct with the rollers 15 engaging the internal diameter e.g. at D. Further the centraliser 1 can pass into a smaller diameter section $D_2$ while still in a centralised condition as the arms 4 will swing inwardly against the action of spring 7 to permit this movement and the arms can then move outwardly when the restriction is past. Since the spring stack 7 is relatively long the increase in spring force over the travel of the expanding arms 4 is low, thereby aiding passage through diminishing diameters. Therefore the centraliser 1 according to the present invention has the following advantages:

1. Aids Centralisation throughout run-in and pull-out operations in pipes and ducting;
2. The use of single arm rollers set in a triangular arrangement provides efficiency while being economic;
3. The centraliser spring load can be adjusted conveniently over a wide range, and if further variation is required a spring of different rating can be installed simply by removing the member 8;
4. The pusher member 6 ensures commonality of movement of the arms 4; and
5. The arms can be set at maximum extension (diameter) and accommodate conveniently diameters less than the maximum rating diameter.

Figure 5:
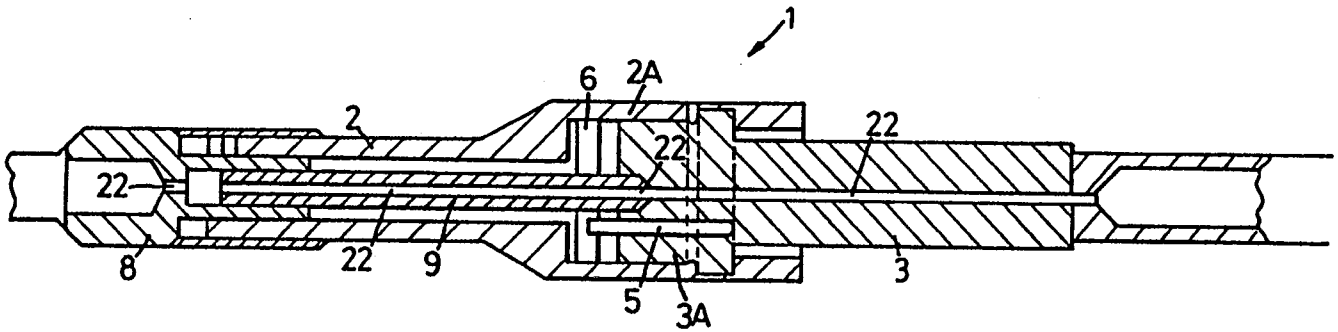
FIG. 5 shows a side view of the centraliser body parts with a modification.

In the modification shown in FIG. 5, a sealed through-ducting 22 is present extending end-to-end of the centraliser 1 and this through-ducting permits the passage of pressurised fluids through the centraliser for passage to a receiving device e.g. tool, the centraliser 1 nevertheless being capable of functioning normally. In particular the centraliser 1 could be used with coiled tubing, the pressurised fluid passing through the centraliser to carry out coiled tubing operations. Also, the diameter selected for the ducting 22 can be from a variety of sizes and in particular the diameter may be such as to permit a tool to be passed into the ducting.

Modifications are possible of course. For example, instead of rollers 15 some other form of implement could be fitted at the free ends of arms 4: in particular a tool could be fitted on each arm 4 to carry out a work operation.

I claim:

1. A centralizer comprising a body including carrying means for a plurality of swinging arms, each swinging arm being pivotally attached to the carrying means at a pivot axis, each swinging arm having a free end and an outer portion adapted to support a roller or other implement; actuating means for swinging of the arms between retracted and extended positions, and including loading means providing a centralizer load countering swinging of the arms, the swinging arms swinging in generally tangential planes off-set from the center line of the carrying means, wherein the swinging arms lie on the outside of a central body portion of the carrying means and each pivot axis of the swinging arms extends substantially through the center line of the carrying means.

2. A centralizer as claimed in claim 1, wherein the actuating means comprises a series of actuators associated with respective swinging arms and the centralizer further comprises means for providing simultaneously swinging of the arms upon operation of the actuators, said providing means being located on the opposite side of said pivot axis from the outer portion of each swinging arm.

3. A centralizer as claimed in claim 1, wherein the actuators engage the swinging arms at a point on the opposite side of the pivot axis from said outer portion to cause swinging of the arms via a fulcrum on the arms acting about the pivot axis.

4. A centralizer as claimed in claim 1, wherein the actuating means comprises actuator rods operatively engageable by a common pusher member.

5. A centralizer as claimed in claim 1, wherein the carrying means includes an elongate member of generally polygonal cross section with a plurality of flat surfaces, each of said plurality of flat surfaces having one of said plurality of swinging arms pivotally attached thereto so that in the retracted position the arm lies adjacent the flat surface.

6. A centralizer as claimed in claim 5, wherein the elongate member is generally of triangular cross-section to provide three flat surfaces and wherein three swinging arms are provided.

7. A centralizer as claimed in claim 1, further comprising means for adjusting the centralizer loading.

8. A centralizer as claimed in claim 7, wherein the load adjusting means comprises an adjuster member mounted to be axially movable relative to the body with the loading means located between the adjuster member and an actuator member.

9. A centralizer as claimed in claim 8, wherein the adjuster member is movably connected to the body.

10. A centralizer as claimed in claim 8, further comprising locking means to lock the adjuster member in set positions.

11. A centralizer as claimed in claim 1, wherein the loading means comprises at least one mechanical spring device.

12. A centralizer as claimed in claim 11, wherein the spring device comprises a stack of belleville washers carried by a spindle.

13. A centralizer as claimed in claim 1, wherein the carrying means includes a head portion adapted to be received in a complimentary head portion of the body, said head portions being arranged to preclude relative rotational movement between the body and the carrying means.

14. A centralizer as claimed in claim 1, wherein the swinging arm includes a main portion including the pivot axis of the arm and a nose portion extending beyond the roller.

15. A centralizer as claimed in claim 4, wherein the swinging arm is cranked with the nose portion inclined relative to the main portion to form an elbow so that the portions form an inwardly facing obtuse angle.

16. A centralizer as claimed in claim 15, wherein the nose portion includes a tapering outer surface to facilitate movement of the centralizer over shoulders and through recesses.

17. A centralizer as claimed in claim 15, wherein the roller is located at the elbow of the cranked swinging arm.

18. A centralizer as claimed in claim 1, wherein the swinging arm includes means to restrict swinging of the arm.

19. A centralizer as claimed in claim 1, wherein the body and the carrying means include a through bore permitting the flow of pressurized fluid through the centralizer without affecting the centralizing operation of the centralizer.

20. A centralizer as claimed in claim 19, wherein the through bore is of sufficient diameter to allow the insertion of a tool.

* * * * *

UNITED STATES PATENT AND TRADEMARK OFFICE

CERTIFICATE OF CORRECTION

PATENT NO. : 5,355,950

DATED : October 18, 1994

INVENTOR(S) : Klaas Zwart

It is certified that error appears in the above-identified patent and that said Letters Patent is hereby corrected as shown below:

In column 2, line 33, delete "carried" and insert -- carries --.

In column 5, Claim 15, line 5, delete "4" and insert -- 14 --.

Signed and Sealed this

Fourteenth Day of February, 1995

*Attest:*

*Attesting Officer*

BRUCE LEHMAN

*Commissioner of Patents and Trademarks*